US007070158B1

(12) United States Patent
Gamble

(10) Patent No.: US 7,070,158 B1
(45) Date of Patent: Jul. 4, 2006

(54) SUPPORT SYSTEM FOR CONCRETE COLUMN FORMWORK AND RELATED BRACKET

(75) Inventor: Roger W. Gamble, Sleepy Hollow, IL (US)

(73) Assignee: USA Form, Inc., West Chicago, IL (US)

( * ) Notice: Subject to any disclaimer, the term of this patent is extended or adjusted under 35 U.S.C. 154(b) by 202 days.

(21) Appl. No.: 10/672,861

(22) Filed: Sep. 26, 2003

(51) Int. Cl.
*E04G 11/48* (2006.01)
*E04G 17/16* (2006.01)

(52) U.S. Cl. ..... 249/20; 249/219.1; 248/235

(58) Field of Classification Search ..... 249/19, 249/20, 23, 24, 25, 210, 211, 219.1; 425/65; 248/235, 241, 243
See application file for complete search history.

(56) References Cited

U.S. PATENT DOCUMENTS

| | | | | | |
|---|---|---|---|---|---|
| 762,540 | A * | 6/1904 | Lewis | 248/241 |
| 946,991 | A * | 1/1910 | Barnum | 249/20 |
| 1,630,080 | A * | 5/1927 | Fels | 425/65 |
| 2,290,535 | A * | 7/1942 | Cavins | 248/235 |
| 3,154,832 | A * | 11/1964 | Weidner | 249/20 |
| 3,583,666 | A * | 6/1971 | Horstketter | 249/20 |
| 3,584,825 | A * | 6/1971 | Williams | 249/23 |
| 3,632,079 | A * | 1/1972 | Rohlf | 249/20 |
| 3,728,838 | A * | 4/1973 | Stout | 52/745.02 |
| 3,861,634 | A * | 1/1975 | Hood et al. | 249/23 |
| 3,966,158 | A * | 6/1976 | Boundy | 248/243 |
| 4,021,011 | A * | 5/1977 | Karlsson et al. | 248/235 |
| 4,040,774 | A * | 8/1977 | Scheller | 425/65 |
| 4,450,121 | A * | 5/1984 | Bequette | 264/31 |
| 5,016,855 | A * | 5/1991 | Huggins | 249/20 |
| 5,083,739 | A * | 1/1992 | Shook et al. | 249/24 |
| 5,104,089 | A * | 4/1992 | Shook et al. | 249/23 |
| 5,676,874 | A * | 10/1997 | Lee | 249/19 |
| 5,755,981 | A * | 5/1998 | Payne | 249/24 |
| 6,003,630 | A * | 12/1999 | Whalen | 248/235 |

* cited by examiner

*Primary Examiner*—Michael Safavi
(74) *Attorney, Agent, or Firm*—John L. Schmitt

(57) ABSTRACT

Formwork for erecting a crown on a top end of a structural concrete column of a highway bridge is supported by a pair of vertically positioned elongated jack-screws. Lower ends of these jack-screws are threaded respectively into adjusting nuts seated on outer ends of respective horizontal arms of a pair of brackets. Each bracket includes an upright support member. These members are attached respectively to opposite sides of the column. The vertical location of the formwork attached to an upper end of a jack-screw may be adjusted up or down by selective rotation of the adjusting nut into which that jackscrew is assembled.

12 Claims, 2 Drawing Sheets

SUPPORT SYSTEM FOR CONCRETE COLUMN FORMWORK AND RELATED BRACKET

BACKGROUND OF THE INVENTION

1. Field of Invention

This invention relates generally to support systems for concrete formwork and more particularly to a support system and related bracket for formwork for casing a crown on a top end of a concrete structural column of a highway bridge.

2. Prior Art

As is well known, use of concrete as a building material concurrently requires formwork to hold and shape just poured concrete until that concrete is sufficiently cured to allow removal of the formwork. Until formwork removal, the curing concrete and formwork must be secured by a formwork support system.

One early concrete formwork support system is disclosed in U.S. Pat. No. 3,504,879. This system includes a bracket attachable to a side to a structural column of a building under construction to support the formwork needed for casting an above floor of the building. This bracket has a vertical tubular body formed with internal threading for disposition of a vertically positioned jack screw. An upper end of the jack-screw has an internal bore to rotatably receive a pin attached to a bottom side of a horizontally positioned, channel-shaped support head. Extending horizontally inward from the body is a pair of spaced apart upper and lower projections. These projections include respective passages to receive a pair of mounting bolts that extend outward from the column. Attached to an outer end of the upper projection is a horizontally positioned roller.

For use, the bracket is attached to the column using the mounting bolts. A bottom beam of the formwork then is positioned in the support head, and the formwork raised to a desired location by rotating the jack-screw. When the concrete poured onto the formwork has set, the formwork may be lowered by rotating the jack-screw in a reverse direction until the formwork beam rests on the bracket roller. The formwork then may be rolled out from under the now semi- cured concrete floor above.

A further bracket for a concrete formwork support system is disclosed in U.S. Pat. No. 3,863,877. This bracket comprises a column-attached support part and a movable jack part. The jack part then includes a base plate that operatively carrying a vertically positioned jack- screw. On an upper end of the jack-screw is a frame that supports a pair of rollers. Each roller has a cylindrical traction section and connecting spool-shaped flange. Attached to respective side edges of the jack part base plate is pair of inward facing channels. Slidably disposed in these channels are respective side edges of a pair of spaced apart shelf arms of the bracket support part. The arms in turn are attached to respective top edges of a pair of triangular shaped gusset plates that then are attached to a vertically positioned backing plate. This backing plate is prepared to be attached to a side of a structural column of a building under construction.

A laterally adjustable bracket for shoring concrete formwork is set out in U.S. Pat. No. 3,967,806. This bracket includes a horizontally positioned, angle-shaped arm having an inner end joined to a vertically positioned end plate attachable to a side of a concrete column of a building under construction. This bracket further includes a vertically positioned plate member formed with an inverted L-shaped opening for disposition of the angle-shape arm. Attached to an outer side of the plate are spaced apart, upper and lower projections of a jack-screw unit having a vertical cylindrical portion to operatively receive a jack-screw. A support head is attached to a top end of the jack-screw. On an outer end of the upper projection is a pair of spaced apart lugs to hold ends of a shaft for a horizontally positioned roller. The plate member and attached jack- screw unit may slide laterally along the bracket angle arm until the support head is properly aligned with the formwork above. The location of the plate member and jack-screw unit then are secured in place by inward threading of a fastener carried by one of a pair of spaced apart ears on the plate member. These ears are positioned on respective sides of a vertical leg of the angle arm.

Other examples of formwork support systems are disclosed in U.S. Pat. Nos. 3,797,794; 3,815,858; 3,900,179; and 4,768,939.

SUMMARY OF THE INVENTION

A support system of this invention for supporting formwork needed for forming a crown on a top of a concrete column of a highway bridge includes a pair of brackets attached respectively to opposite sides of the column. Each bracket includes an upright having a pair of upper openings for selective disposition of an end of a threaded rod that extends through a tube embedded in the column. Nuts threaded onto the rod ends then compressively secure the brackets to the column. Each bracket further includes an outward extending arm supported in part by an angularly positioned pair of braces that extends from a lower end of the bracket upright to an outer end of the bracket arm. Carried on the outer end of the arm is an adjusting nut to receive a threaded lower end of a vertically positioned jack-screw. An upper end of each jack-screw operatively connects to the formwork above to hold the crown formwork in place until concrete contained by this formwork is sufficiently cured to permit removal of the formwork and supporting structure.

The support system and related brackets of the invention provide several advantages over like support systems known or in use.

A first advantage is that system only requires two brackets to support the formwork above.

A second advantage is that the lateral location of either bracket as attached to a column may be adjusted depending on which pair of openings is selected for disposition of the threaded rod carried by the column. The lateral position of the point for attaching the jack-screw to the formwork also is considered when selecting the bracket opening pair for insertion. Once selected, then only one nut threaded onto the rod end is required to secure that bracket to that side the column. Note that the threaded rod and brackets are reusable.

A last advantage is that the bracket structure may be fabricated using ready available steel structural shapes. By using selective shaped steel members, the brackets may be easily configured to support substantial weight.

DESCRIPTION OF THE DRAWING FIGURES

DESCRIPTION OF THE PREFERRED EMBODIMENT

Figure 1:
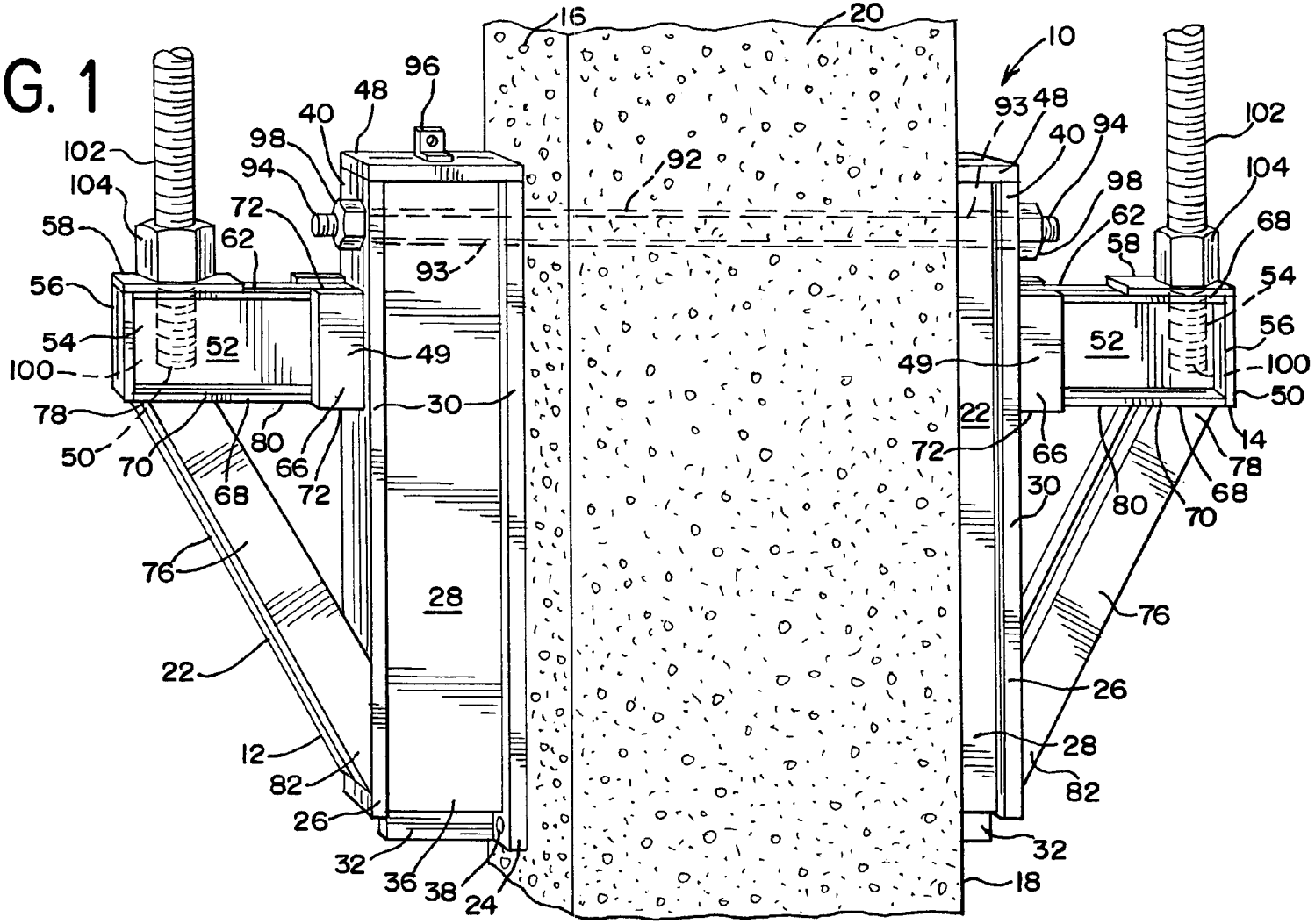
FIG. 1 is a perspective view of the support system of this invention.

A system for supporting formwork needed to form of a crown on a top end of a concrete column of a highway bridge is shown generally in FIG. 1 and designated 10. The system 10 includes a pair of brackets 12, 14 attached to opposite sides 16, 18 of a concrete column 20. Since the structure of each bracket 12, 14 is the same, only the bracket 12 is described in detail. Like reference numbers are used to identify like structure.

Figures 2, 3, 4, 5:
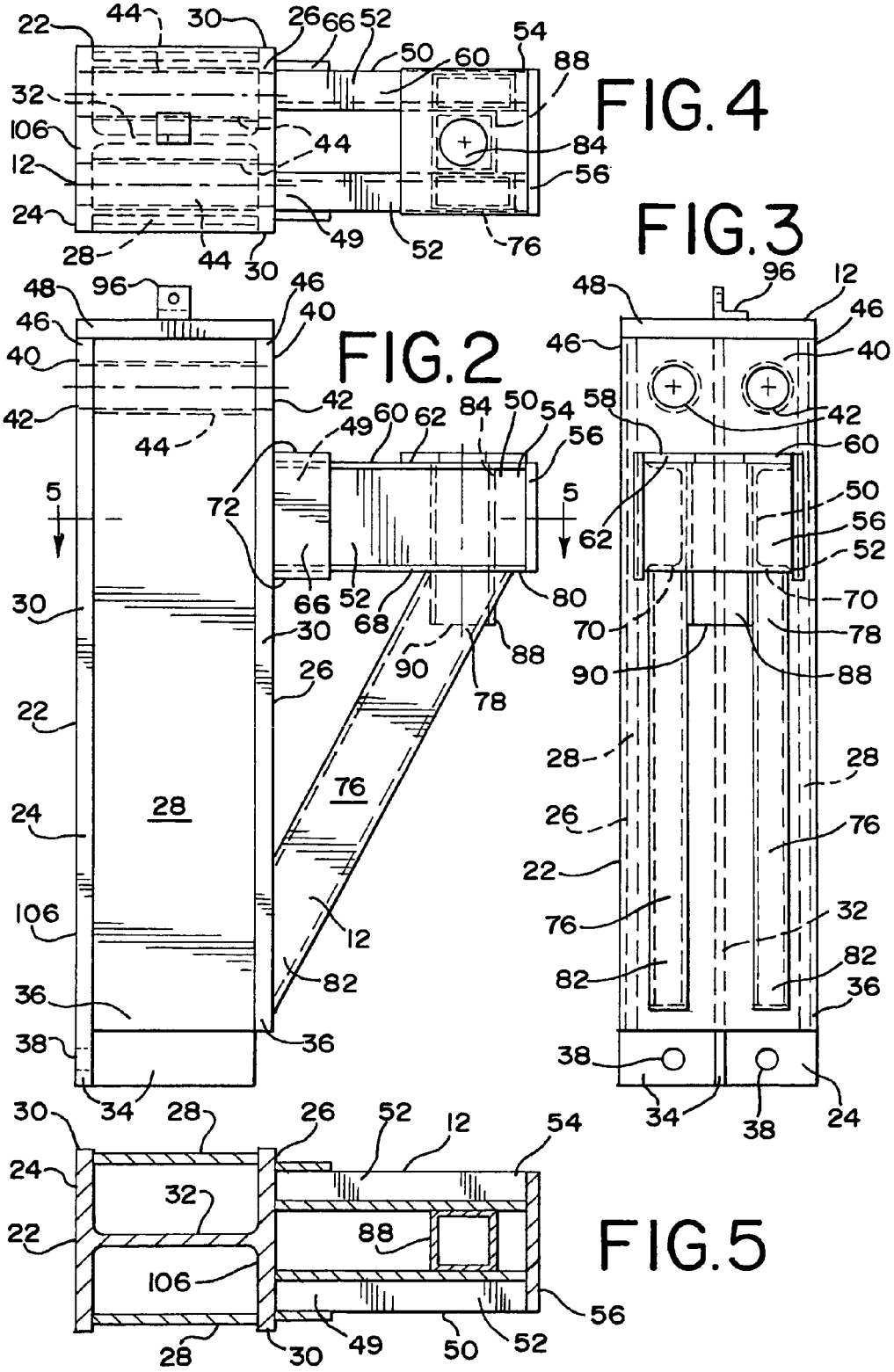
FIG. 2 is a side elevation view of a bracket of the system of FIG. 1.
FIG. 3 is a front elevation view of the bracket of FIG. 2.
FIG. 4 is a plan view of the bracket of FIG. 2.
FIG. 5 is a cross sectional view of the bracket as seen generally along the line 5—5 of FIG. 2.

The bracket 12 is defined by an upright 22 having an inner and outer wall 24, 26 and sidewalls 28. As best seen in FIG. 5, each sidewall 28 is inwardly offset from side edges 30 of the inner and outer walls 24, 26. Additionally, an inner partition 32 positioned parallel to and between the sidewalls 28 connects the inner and outer walls 24, 26. As seen in FIGS. 2 and 3, bottom ends 34 of the inner wall 24 and the partition 32 extend below bottom ends 36 of the outer wall 26 and the sidewalls 28. A pair of horizontally spaced apart oblong-shaped mounting holes is formed in the inner wall 24 on either side of the partition 32 just above the inner wall bottom end 34.

In an upper portion 40 of the inner wall 24 and the outer wall 26 are two pairs of horizontally spaced apart and horizontally aligned openings 42. Extending between the inner and outer walls 24, 26 in alignment with each opening pair is a tube 44. An inside diameter of each tube 44 is greater than a diameter of the openings 42. Attached to top ends 46 of the inner and outer walls 24, 26 and sidewalls 28 is a top plate 48.

Attached to the upright outer wall 26 is an inner end 49 of an arm 50. This arm 50 extends horizontally outward and is defined by two spaced apart channel members 52. Attached to outer ends 54 of the channel members 52 is an end plate 56. A jack-screw plate 58 then is attached to top surfaces 60 of top flanges 62 of the arm channel members 52 adjacent to the end plate 56.

To enhance the connection between the arm inner end 49 and the upright outer wall 26, a pair of reinforcing plates 66 is attached respectively to side edges 68 of the channel member top flanges 62 and bottom flanges 70 and to the upright outer wall 26. Note that top and bottom edges 72 of each reinforcing plate 66 extend respectively above and below the channel member top flange 62 and bottom flange 70. Additionally, the fixed position of the arm 50 is enhanced by a pair of spaced apart, angularly positioned tubular braces 76. Upper ends 78 of these braces 76 are attached one each to a bottom surface 80 of each channel member bottom flange 70 while lower ends 82 of the braces 76 are attached to the upright outer wall 26. Carried between the channel members 52 in alignment with an opening 84 in the jack-screw plate 58 is a vertically positioned jack-screw tube 88. Note that a bottom end 90 of the tube 88 extends below the bottom surface 80 of the channel member bottom flanges 70.

For use as seen in FIG. 1, the brackets 12, 14 are positioned on respective sides 16, 18 of the column 20. During forming of the column 20, a tube 92 has been embedded in the column 20 for disposition of a threaded rod 93. Outer ends 94 of the rod 93 then extend beyond the column sides 16, 18. One each of the rod ends 94 is inserted into one of the pair of aligned openings 42 in each bracket upright 22. Selection of which pair of aligned openings 42 to use for rod end insertion depends on the desired location of each bracket 12, 14 since the tube 92 may not be centered in the column 20. Mechanically positioning of the brackets 12, 14 is facilitated by operative use of a lifting lug 96 attached to the top plate 48 on each bracket upright 22. This lifting lug 96 is positioned to vertically align with a center of gravity of each bracket 12, 14.

Once in place, the brackets 12, 14 are compressively secured to the column 20 by nuts 98 threaded on the respective ends 94 of the rod 93. Additionally, the bottom end 34 of each bracket inner wall 24 is secured to the column 20 by an anchor bolt (not shown) inserted into the column 20 through one of the openings 38. Next, a bottom end 100 of a jack-screw 102 is inserted through in each jack-screw plate opening 84 so that this bottom end 100 fits into the respective tube 88 located below the jack-screw plate 58. Each jack-screw 102 then is held vertically in place by a jack-screw nut 104 assembled on that jack-screw 102 as the nut 104 seats of the bracket jack-screw plate 58. The vertical location of a top end (not shown) of each jack-screw 102 may be adjusted by rotation of the nut 104 for selective attachment to the column crown formwork above (not shown). Once attached, the system 10 may support the formwork and uncured concrete poured into the formwork for casing the crown.

The system 10, as its use is described above, supports working loads of 200,000 pounds with a safety factor of 500,000 pounds. To meet this requirement the brackets 12, 14 are made using selective structural steel shapes. For example, the inner and outer walls 24, 26 and the inner partition 32 of each bracket upright 22 are integrally formed as flanges and a web of a 10 in. structural steel H-beam 106 having a weight of 77 pounds/linear foot. The bracket sidewalls 28 then are made from ½ in. thick steel plate. The arm channel member 52 are 6 in. structural steel channels having a weight of 13 pounds/linear foot. Lastly, the braces 76 are made from 2 in.×4 in.×3/16 in. thick steel tubes. These structural members 106, 28, 32, and 76 then are welded together.

While an embodiment, uses, and advantages of this invention have been shown and discussed, it should be understood that this invention is limited only by the scope of the claims. Those skilled in the art will appreciate that various modifications and changes may be made without departing from the scope and spirit of the invention, and these modifications and changes may result in farther uses and advantages.

What I claim is:

1. A bracket for a system for supporting formwork for forming a crown on a concrete column of a highway bridge, said bracket including:

a box-shaped upright defined by spaced apart inner and outer walls connected by sidewalls, a central partition positioned between said sidewalls and connected to said inner and outer walls, sets of aligned openings formed respectively in an upper portion of said inner wall and said outer wall, and a set of tubes positioned on respective sides of said central partition to align respectively with said opening sets, a horizontally positioned support arm defined by spaced apart channel members having inner ends attached to said upright outer wall immediately below said outer wall openings, an end plate attached to outer ends of said channel members, a jack-screw plate formed with a jack- screw opening prepared for disposition of a lower end of a jack-screw and attached to top flanges of said channel members, a jack-screw tube carried by said channel members inward from said end plate to align with said jack-screw plate opening, and a pair of reinforcing plates attached respectively to said channel members and to said upright outer wall, and a pair of angularly positioned tubular braces having lower ends attached to said upright outer wall and upper ends attached respectively to bottom flanges of said support arm channel members, wherein for use, said bracket is affixed to a respective side of said column by a bolt extending outward from said respective side of said column and through one said set of aligned openings in said bracket upright inner and outer walls, said formwork is attached to an upper end of said jack-screw having said lower end disposed in said bracket jack-screw opening, and a vertical location of said formwork is adjusted by rotation of a jack-screw nut operatively disposed on said jack screw.

2. A bracket as defined by claim 1 and further characterized by, said inner wall, said outer wall, and said central partition of said bracket upright being integrally formed to have a H-beam like cross-sectional shape.

3. A bracket as defined by claim 2 and further characterized by, said sidewalls of said bracket upright being inwardly offset from side edges of said inner and outer walls.

4. A bracket as defined by claim 1 and further characterized by, bottom ends of said bracket upright inner wall and said central partition extending below bottom ends of said upright outer wall and sidewalls, and said bottom end of said inner wall being formed with spaced apart oblong-shaped openings located on respective sides of said partition.

5. A bracket as defined by claim 1 and further characterized by, said jack-screw tube of said bracket having a square-like cross-sectional shape, and a bottom end of said jack-screw tube extending below said bottom flanges of said arm channel members.

6. A bracket as defined by claim 5 and further characterized by, said bottom end of said bracket jack-screw tube fitting between said upper ends of said bracket braces.

7. A bracket as defined by claim 1 and further characterized by, said reinforcing plates of said bracket having top and bottom edges extending respectively above and below said upper and lower flanges of said support arm channel members.

8. A bracket as defined by claim 1 and further characterized by, said bracket having a top plate attached to top ends of said upright walls, and a lifting lug attached to said top wall and positioned in proximate vertical alignment with a center of gravity of said bracket.

9. A bracket particularly adapted for supporting formwork for casting a crown on an upper end of a highway bridge concrete column, said bracket comprising:

an upright having a box-like shape, said upright including an inner partition extending between an inner wall and an outer wall of said upright, an arm attached to said upright outer wall and extending outward therefrom, said arm including a jack-screw plate attached to an outer end of said arm with said plate having an opening aligned with a vertically positioned tube carried by said arm, and a brace having an upper end attached to said arm outer end and a lower end attached to said upright outer wall, wherein during use said bracket is attached to a side of said column, and a lower end of a jack-screw is disposed in said jack-screw plate opening and tube with a vertical position of said jack-screw adjustably secured by a nut threaded onto said jack-screw and seated on said jack- screw plate.

10. A bracket particularly adapted for supporting formwork for casting a crown on an upper end of a concrete column, said bracket comprising:

an upright having spaced apart inner and outer walls connected by sidewalls and an inner partition located between said sidewalls, a pair of aligned openings formed in an upper portion of said inner wall and said outer wall, a pair of tubes fitting between and aligned respectively with each said opening pair, and a top plate joined to top ends of said inner wall, said outer wall, and said sidewalls, an arm defined by a pair of spaced apart channel members having inner ends attached to said upright outer wall, an end plate attached to outer ends of said channel members, a jack-screw plate attached to top flanges of the channel members adjacent to said end plate, and a jack-screw tube carried by said arm between said channel members to align with an opening in said jack-screw plate, a pair of reinforcing plates attached to respective side edges of said arm channel member top flanges, to side edges of bottom flanges of said channel members, and to said upright outer wall with top and bottom edges of said plates extending respectively above and below said channel member flanges, and a pair of spaced apart braces having upper ends attached respectively to lower surfaces of said arm channel member bottom flanges adjacent a bottom end of said jack-screw tube and lower ends attached to said upright outer wall, wherein for use an end of a cross-beam carried by said column is selectively inserted through one said pair of said bracket upright openings and said bracket is compressively secured to said column with a nut operatively assembled on said cross-beam end, a jack-screw is positioned in said bracket arm jack-screw plate opening and jack-screw tube and adjustably secured therein by a nut operatively assembled on said jack-screw and seated on said jack-screw plate, and an upper end of said jack-screw is connected to said formwork to support said formwork and contained uncured concrete as said concrete cures to form said crown.

11. A bracket as defined by claim 10 and further characterized by, a lifting lug attached to said bracket upright top plate to proximately align vertically with a center of gravity of said bracket, said upright sidewalls being inwardly offset from side edges of said inner and outer walls, bottom ends of said upright inner wall and partition being downwardly offset from bottom ends of said upright outer wall and said upright sidewalls, and said upright inner wall having a pair of spaced apart, oblong-shaped openings located below said upright sidewall bottom ends.

12. A bracket as defined by claim 10 and further characterized by, said upright inner wall, said outer wall and said partition being an integrally formed structural steel H-beam.

* * * * *